US007441291B2

(12) United States Patent
Hayes et al.

(10) Patent No.: US 7,441,291 B2
(45) Date of Patent: Oct. 28, 2008

(54) PROFILING BED

(75) Inventors: Stephen Hayes, Dudley, Kingswinford (GB); Stephen Hollyoak, Dudley, Kingswinford (GB)

(73) Assignee: Huntleigh Technology Limited (GB)

( * ) Notice: Subject to any disclaimer, the term of this patent is extended or adjusted under 35 U.S.C. 154(b) by 252 days.

(21) Appl. No.: 10/514,586

(22) PCT Filed: May 13, 2003

(86) PCT No.: PCT/GB03/02018

§ 371 (c)(1),
(2), (4) Date: Jul. 18, 2005

(87) PCT Pub. No.: WO03/096955

PCT Pub. Date: Nov. 27, 2003

(65) Prior Publication Data

US 2006/0000021 A1 Jan. 5, 2006

(30) Foreign Application Priority Data

May 17, 2002 (GB) ..... 0211372.8
Oct. 31, 2002 (GB) ..... 0225373.0
Feb. 28, 2003 (GB) ..... 0304624.0

(51) Int. Cl.
*A61G 7/015* (2006.01)

(52) U.S. Cl. ..... 5/618; 5/617; 5/624

(58) Field of Classification Search ..... 5/618, 5/616, 617, 613, 610, 621, 624
See application file for complete search history.

(56) References Cited

U.S. PATENT DOCUMENTS 428,938 A * 5/1890 Oxley ..... 5/617
673,366 A * 4/1901 Luria ..... 5/611
866,309 A * 9/1907 Scanlan ..... 5/618
912,214 A * 2/1909 Ward ..... 5/618
2,101,290 A * 12/1937 Pierson ..... 297/130
3,353,193 A * 11/1967 Greiner ..... 5/617
3,503,082 A * 3/1970 Kerwit ..... 5/601
3,593,350 A * 7/1971 Knight et al. ..... 5/616
3,686,696 A * 8/1972 Lanigan ..... 5/611

(Continued)

FOREIGN PATENT DOCUMENTS

DE 12 83 437 B 11/1968

(Continued)

*Primary Examiner*—Robert G Santos
(74) *Attorney, Agent, or Firm*—Craig A. Fieschko, Esq.; DeWitt Ross & Stevens S.C.

(57) ABSTRACT

A profiling bed or similar support surface having a back section, seat section, thigh and calf section convertible to a chair configuration. The back section is mounted on an angled slide to retract as it is rotated. The angle of the slide also provides upward lift of the back section as it is retracted and rotated. This combination of movements mimics the way a person's tissues stretch when they move to a sitting position, reducing pressure and shear. At the same time, the thigh section can be rotated to an incline and the calf section either raised into a horizontal configuration or lowered to a chair configuration during movement of the thigh section. In another embodiment the thigh section is also mounted on a slide to retract towards the foot end as it is rotated to an incline, providing reduction of abdominal strain and increased comfort.

24 Claims, 8 Drawing Sheets

U.S. PATENT DOCUMENTS

| | | | | | |
|---|---|---|---|---|---|
| 3,873,152 | A * | 3/1975 | Garas | 297/68 |
| 4,183,109 | A * | 1/1980 | Howell | 5/618 |
| 4,225,127 | A * | 9/1980 | Strutton | 5/602 |
| 4,376,317 | A * | 3/1983 | Johnston | 5/601 |
| 4,409,695 | A * | 10/1983 | Johnston et al. | 5/601 |
| 4,682,529 | A | 7/1987 | Coutin et al. | |
| 4,731,888 | A * | 3/1988 | Bridges | 5/37.1 |
| 5,161,274 | A * | 11/1992 | Hayes et al. | 5/618 |
| 5,205,004 | A * | 4/1993 | Hayes et al. | 5/611 |
| 5,261,725 | A * | 11/1993 | Rudolph | 297/361.1 |
| 5,640,730 | A * | 6/1997 | Godette | 5/618 |
| 5,682,631 | A * | 11/1997 | Weismiller et al. | 5/618 |
| 5,715,548 | A * | 2/1998 | Weismiller et al. | 5/624 |
| 5,790,997 | A | 8/1998 | Ruehl | |
| 5,926,878 | A * | 7/1999 | Morton et al. | 5/624 |
| 6,163,903 | A * | 12/2000 | Weismiller et al. | 5/610 |
| 6,336,235 | B1 * | 1/2002 | Ruehl | 5/610 |
| 6,393,641 | B1 * | 5/2002 | Hensley | 5/618 |
| 6,425,590 | B1 * | 7/2002 | Whiteside et al. | 280/32.6 |
| 6,539,566 | B1 * | 4/2003 | Hayes | 5/618 |
| 6,643,873 | B2 * | 11/2003 | Heimbrock et al. | 5/618 |
| 6,702,305 | B2 * | 3/2004 | Miles | 280/32.6 |
| 6,839,926 | B2 * | 1/2005 | Heimbrock et al. | 5/618 |
| 7,017,208 | B2 * | 3/2006 | Weismiller et al. | 5/600 |
| 7,036,166 | B2 * | 5/2006 | Kramer et al. | 5/618 |
| 7,213,279 | B2 * | 5/2007 | Weismiller et al. | 5/624 |
| 7,237,287 | B2 * | 7/2007 | Weismiller et al. | 5/616 |
| 7,325,265 | B2 * | 2/2008 | Hornbach et al. | 5/618 |
| 2002/0174487 | A1 * | 11/2002 | Kramer et al. | 5/618 |
| 2002/0178502 | A1 * | 12/2002 | Beasley et al. | 5/618 |
| 2006/0000021 | A1 * | 1/2006 | Hayes et al. | 5/618 |
| 2006/0168729 | A1 * | 8/2006 | Weismiller et al. | 5/618 |
| 2007/0180619 | A1 * | 8/2007 | Hayes et al. | 5/618 |

FOREIGN PATENT DOCUMENTS

| | | |
|---|---|---|
| FR | 2 671 468 A | 7/1992 |
| WO | 01 91689 A | 12/2001 |

* cited by examiner

PROFILING BED

The present invention relates to a bed, trolley or similar apparatus and more particularly to a bed, trolley or similar apparatus with a support surface convertible to a chair configuration.

FIELD OF THE INVENTION

Many hospital patients in the acute phase of their illness have restricted levels of mobility, and often remain in bed for long periods of time. Serious complications can develop as a result of this physical inactivity including pressure ulcers, respiratory infections and muscle wastage. Prevention of these complications is a major clinical challenge. It is well-recognised that upright positioning, with the torso raised and the feet down helps to reduce the risk of these complications, and that the risk is reduced further if upright positioning can be combined with mobilisation.

It is known to have beds with profiling surfaces to overcome many of the difficulties associated with positioning and mobilisation of patients. Such profiling surfaces can offer many advantages, including reduced risk of injury to staff and patients, increased patient independence, faster recovery from illness and improved cost-effectiveness.

A number of beds with profiling surfaces are known that achieve a chair configuration to provide good upright positioning. However, accomplishing this usually involves raising the back section and thigh section of the surface and then tilting the bed frame down towards the foot end. This foot-down tilt limits how low the bed can go, and the better the chair configuration, the more compromised the low height of the bed becomes. This results in the patient sitting a long way off the ground, and relies on the carer to take the bed out of tilt in order to lower the height. Transfer on and off this type of bed when in a chair configuration is difficult or even impossible for patients with restricted mobility.

BACKGROUND OF THE INVENTION

The present invention seeks to provide an improved profiling bed or similar device.

SUMMARY OF THE INVENTION

Known beds with profiling surfaces have a simple hinged back section which pushes the patient down the surface as it is raised, exerting pressure and shear on the back, sacrum and heels of the patient. To overcome the problem, some profiling surfaces have a retracting back section that moves backwards at the same time as it is raised, but retraction is limited and the patient is still pushed downwards. In the event of these surfaces being profiled into a chair configuration, the patient would be pushed downwards by the back section. They may even become squashed within the seat section, thereby experiencing excessive abdominal strain as well as pressure and shear on their back, sacrum and heels.

The preferred embodiment can provide a profiling surface that increases the comfort and reduces the pressure and shear experienced by the patient during movement from a horizontal configuration to a profiled configuration.

The preferred embodiment can provide a profiling support surface having a low chair configuration so that the patient can sit in a comfortable seated position at a much lower height, without using the foot down tilt. Patient transfers to and from the support surface in this low chair configuration are much easier than with other profiling surfaces in the same configuration.

The embodiments described herein can provide a greater degree of retraction than achieved previously. They are based on the surprising finding that by inclining the slide mechanism with respect to the frame, an inexpensive and reliable means of obtaining upwards, shear reducing movement of the back section is achieved at the same time as retraction of the back section. This combination of movements mimics the way a person's tissues stretch when they move from a supine to a sitting position and offers the benefits of enhanced pressure and shear reduction over other profiling surfaces. It is envisaged in some embodiments that the slide mechanism could be a curve inclined with respect to the frame to provide greater conformity to the way a person's tissues stretch with movement from a supine to sitting position.

Preferably, the movement of the back section brings about a simultaneous movement of the leg section to bring the bed or trolley into a profiled configuration to a chair position. Therefore, in one operation a low height chair configuration is achieved allowing earlier, more frequent upright positioning and mobilisation of the patient, without relying on the nurse to operate the tilt function on the bed or trolley in order to achieve a chair configuration. This can reduce abdominal strain and improve patient comfort.

Preferably, the leg section includes a thigh section and a calf section, the thigh section being pivotedly mounted on the frame at one end and pivotally connected to the calf section at the other end so that, in order to bring the bed or trolley in the chair configuration, the thigh section is pivoted upwards and the calf section is pivoted downwards.

Preferably, the thigh section is mounted on a slide mechanism to retract away from the seat section as it is pivoted upwardly. The retractable thigh section has the benefit of relieving pressure on the patient as the support surface profiles resulting in reduced abdominal strain and increased comfort.

BRIEF DESCRIPTION OF THE DRAWINGS

The invention will now be described in detail, by way of examples only, with reference to the following drawings, in which.

DETAILED DESCRIPTION OF PREFERRED VERSIONS OF THE INVENTION

Figure 1:
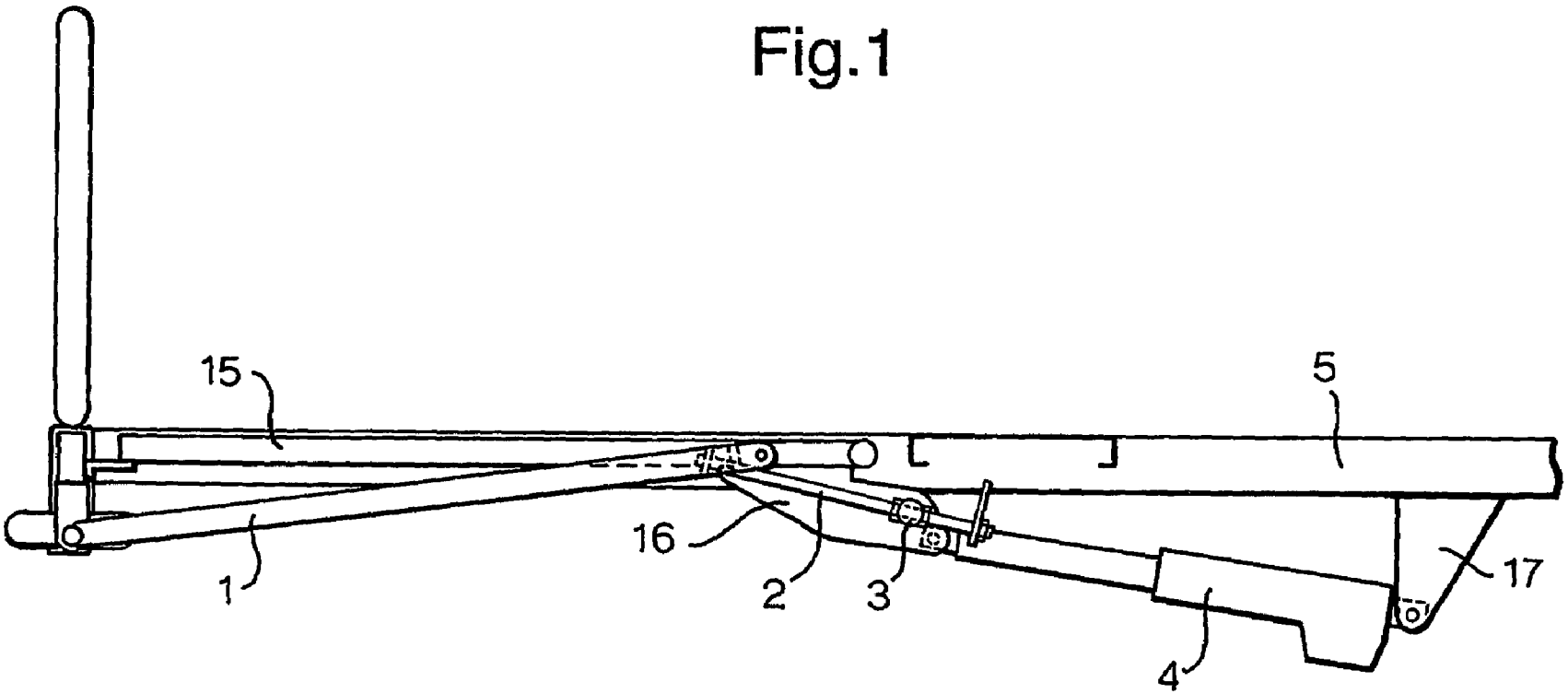
FIG. 1 is a schematic view of a preferred embodiment of back section.

Referring to FIG. 1, there is shown a head part of a bed having a back section 15 according to a preferred embodiment of the invention. The back section 15 is connected to the frame 5 via a strut or link 1, which is pivotally connected at one end to the head end of the frame 5 and pivotally connected at its other end to the back section 15.

The back section 15 is also connected to the frame 5 via a slide mechanism 2. The slide mechanism 2 is fixed in an angular position in relation to the bed frame 5. The back section 15 is connected to the slide mechanism 2 via a joint 3 which allows the back section 15 to both pivot and slide in relation to the slide mechanism 2.

An actuator 4 is pivotally connected to the back section 15 via a lever 16 and pivotally connected to the frame 5 at its other end.

Figure 2:
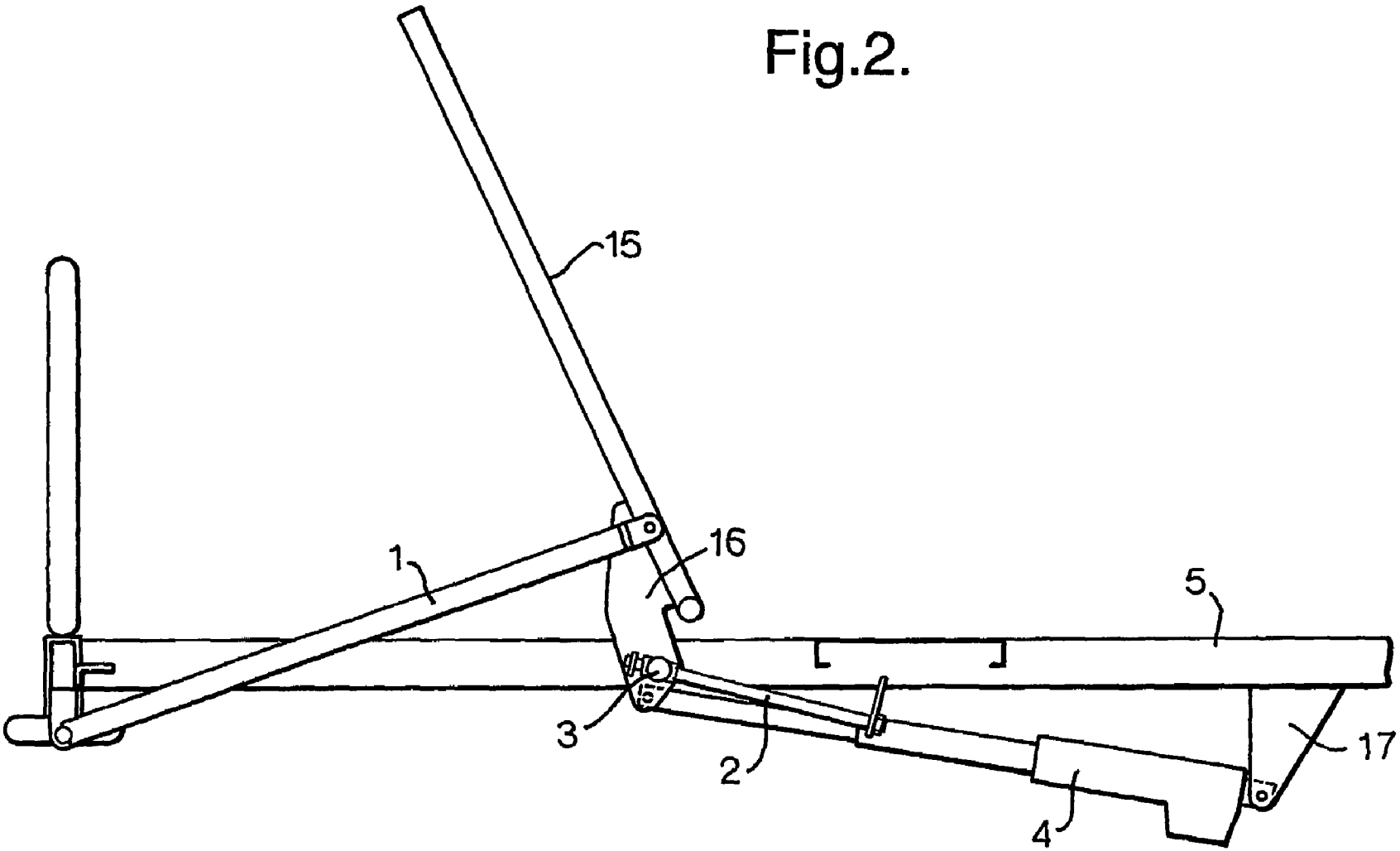
FIG. 2 is a schematic view of the back section in FIG. 1 in a raised position.

Referring to FIG. 2, as the actuator 4 extends it pushes the back section 15 along the slide mechanism 2, while link 1 causes the back section 15 to rotate upward and the angled slide mechanism 2 causes the back section to both retract along the axis of the frame 5 towards the head end of the bed and also rise upward relative to the frame 5.

Figure 3:
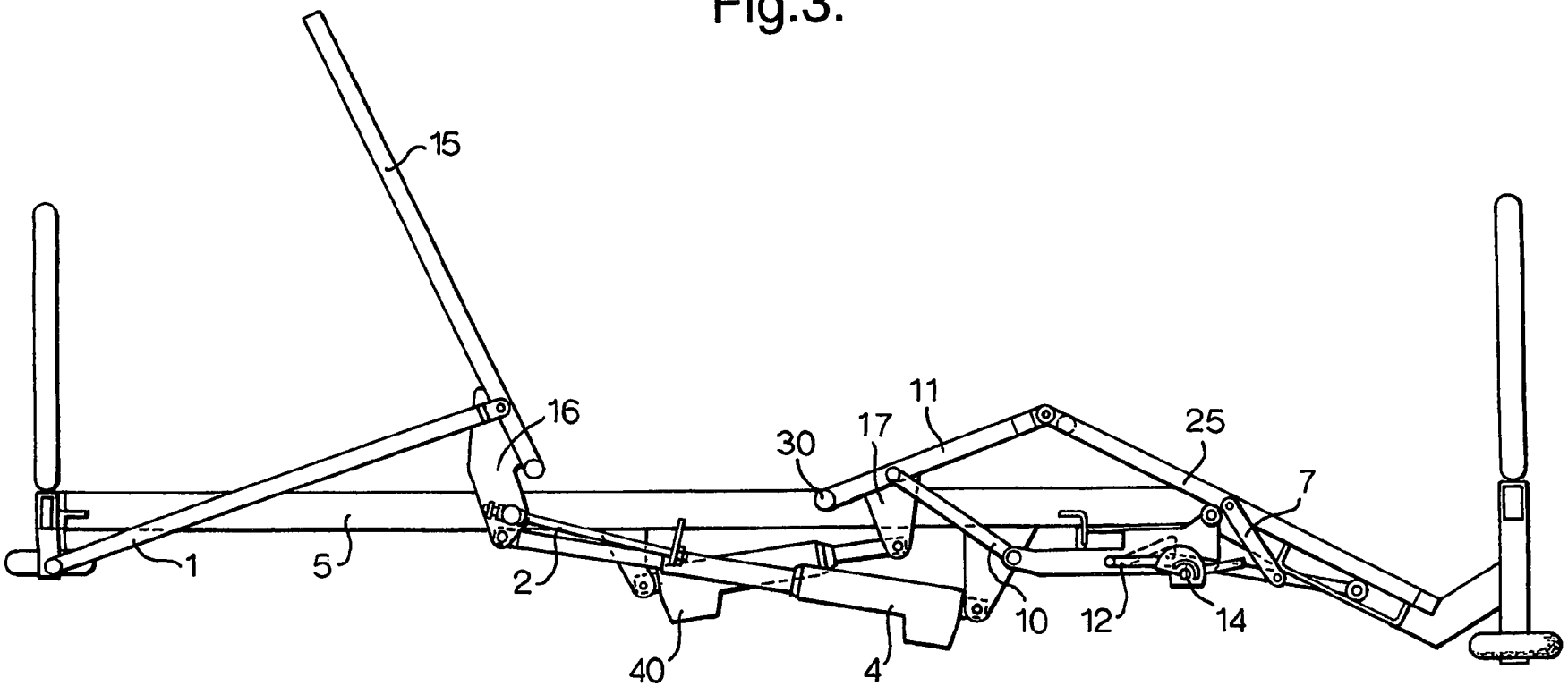
FIG. 3 is a schematic view of the of the support surface in a chair configuration according to one embodiment of the invention.

FIG. 3 shows a complete view of a bed which is also, in this example, provided with a particular thigh and calf section mechanism. In this embodiment, the thigh section 11 is connected to the frame 5 via a strut or link 10 which is pivotally connected at one end to the frame 5 and pivotally connected at its other end to the thigh section 11. An actuator 40 is pivotally connected to the thigh section 11 via a lever 17 and pivotally connected to the frame 5 at its other end.

The calf section 25 is pivotally connected to the thigh section 11 and supported via struts or links 6 and 7. Link 6 is connected to the frame 5 via a slotted bracket 12 and connected to the calf section 25 via a roller 8 running along a track 9. Link 7 is pivotally connected to both link 6 and the calf section 25. Rotary cam 14 is pivotally connected to the slotted bracket 12 and is actuated by handle 13. The rotary cam 14 can be positioned such that it either allows a stay or link 6 to enter a detent 26 in the slotted profile 12 or not.

Figure 4:
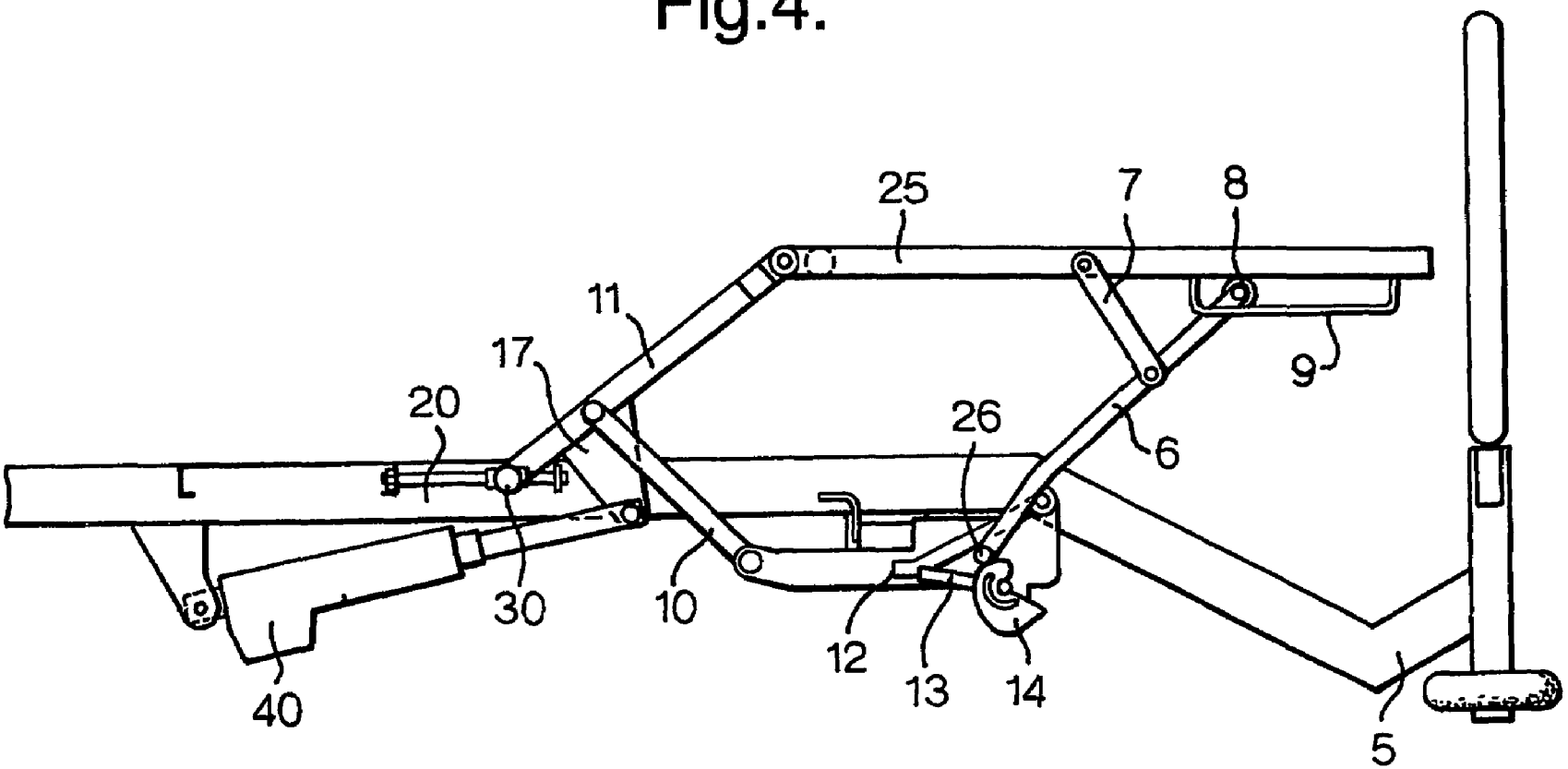
FIG. 4 is a schematic view of the preferred embodiment of thigh section and calf section in the raised horizontal configuration.
Figure 5:
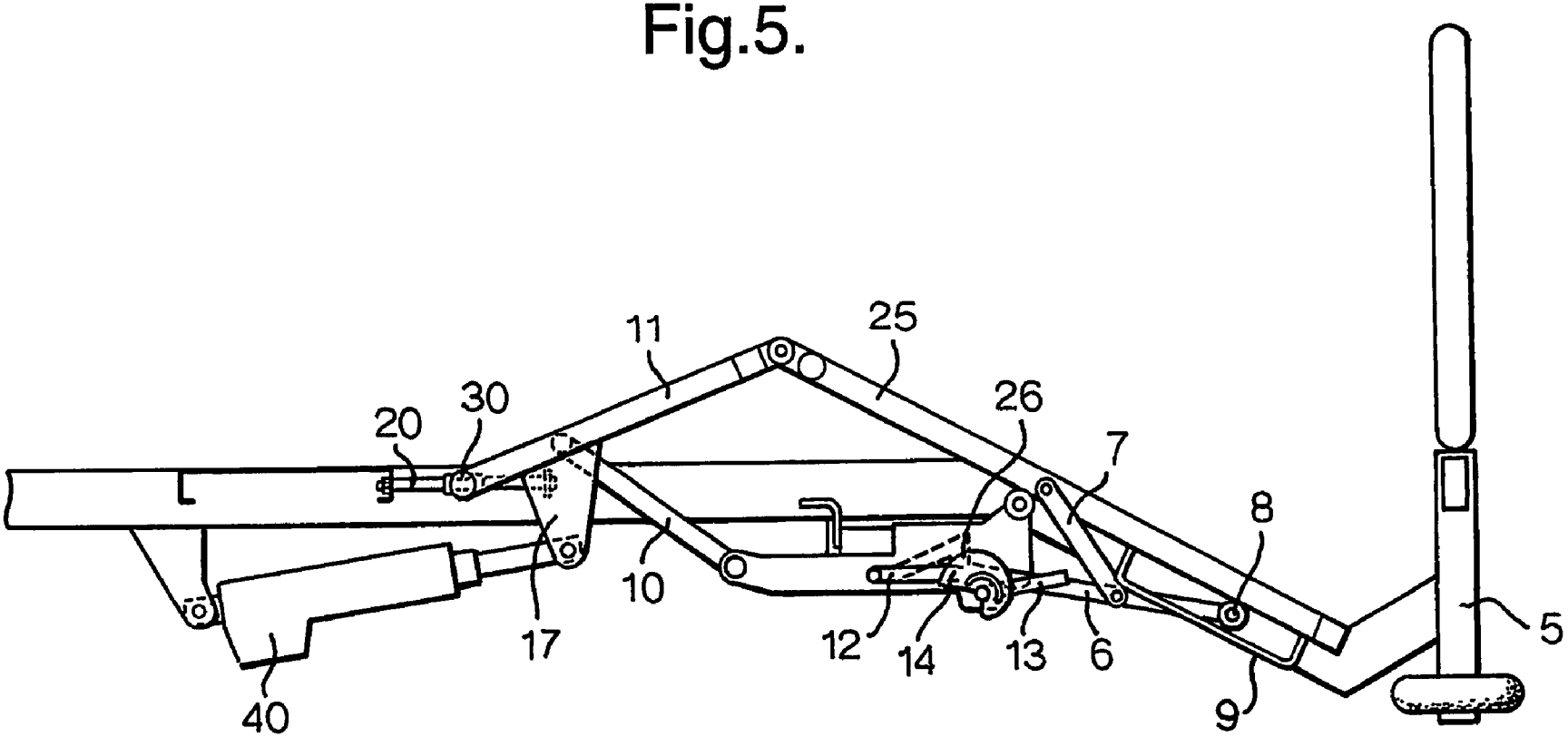
FIG. 5 is a schematic view of the calf section in FIG. 4 in a chair configuration.

As the actuator 40 extends it causes the thigh section 11 to rotate upward, which causes calf section 25 to be pulled upward due to it being pivotally connected to the thigh section 11. If the cam 14 is positioned such that link 6 engages in the detent 26, then the calf section 25 rises in a near horizontal position, as shown in FIG. 4. If the cam 14 is positioned to obstruct the detent 26 such that link 6 cannot engage the detent 26 but travels along the slotted profile 12, then the calf section 25 rises at an angle with its foot end lowered to achieve a chair configuration, as shown in FIG. 5. Therefore, the operator can select between a vascular (horizontal) configuration or chair configuration for the calf section, without having to manually lift the calf section to convert the bed from vascular to chair configuration.

The operator, by means of handle 13, can either rotate the cam 14 to lift the stay of the link 6 out of the vascular detent 26 for the chair configuration or rotate the cam 14 to uncover the vascular detent 26 and allow the stay to drop into the detent 26 for the horizontal position of the calf section. The position of handle 13 can be used to indicate the selected configuration, preferably on a suitable visual indicator.

The actuators 4 and 40 can be driven simultaneously or sequentially to provide a complete profiling of the support surface comprising rotation of the back section 15 into an inclined angle with retraction of the section towards the head end as it inclines, the section also lifting upwardly in relation to the frame, the thigh section rotated to an incline and the calf section either raised into a horizontal position or lowered to a chair configuration.

Figure 6:
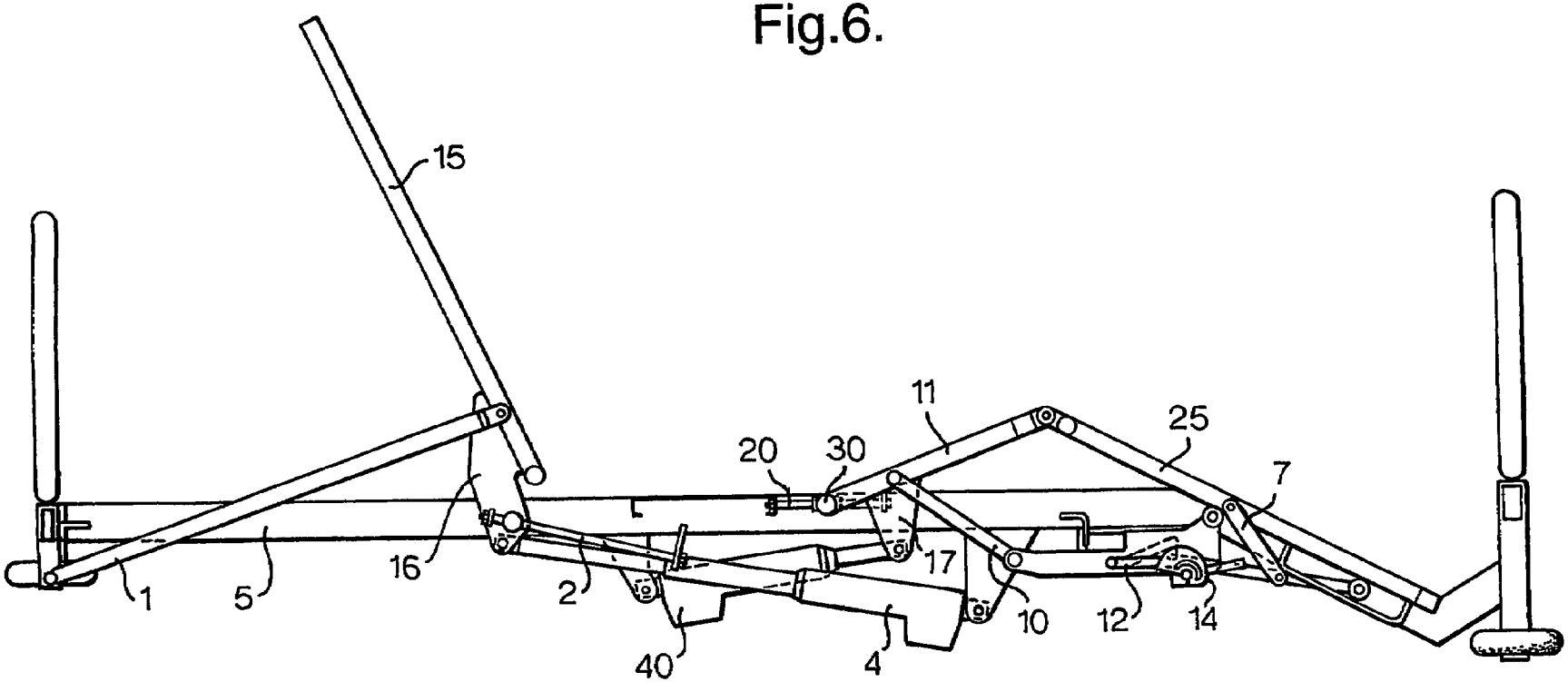
FIG. 6 is a schematic view of the support surface in a chair configuration according to another embodiment of the invention.

In another embodiment of the invention, the thigh section 11 is connected to the frame 5 via a slide mechanism 20, as shown in FIG. 6. The slide mechanism 20 is fixed in a substantially horizontal position in relation to the frame 5. The thigh section 11 is connected to the slide mechanism 20 via a joint 30 which allows it to both pivot and retract in relation to the slide mechanism 20. As the actuator 40 extends it pushes the thigh section 11 along the slide mechanism 20, link 10 causing the thigh section 11 to rotate upward as it retracts along slide mechanism 20 while calf section 25 is pulled upward due to it being pivotally connected to the thigh section 11. The calf section can be selected to profile into a chair or horizontal configuration as described above.

As already described with respect to the first embodiment, the actuators 4 and 40 can be driven simultaneously or sequentially to provide a complete profiling of the support surface comprising rotation of the back section 15 into an inclined angle with retraction of the section towards the head end as it inclines, the section also lifting upwardly in relation to the frame 5, the thigh section 11 rotated to an incline and retracted towards the foot end and the calf section 25 either raised into a horizontal position or lowered to a chair configuration.

Due to the retraction of both back section 15 and thigh section 11 the patient is not subjected to the squeezing action normally experienced on conventional profiling surfaces.

Figure 7:
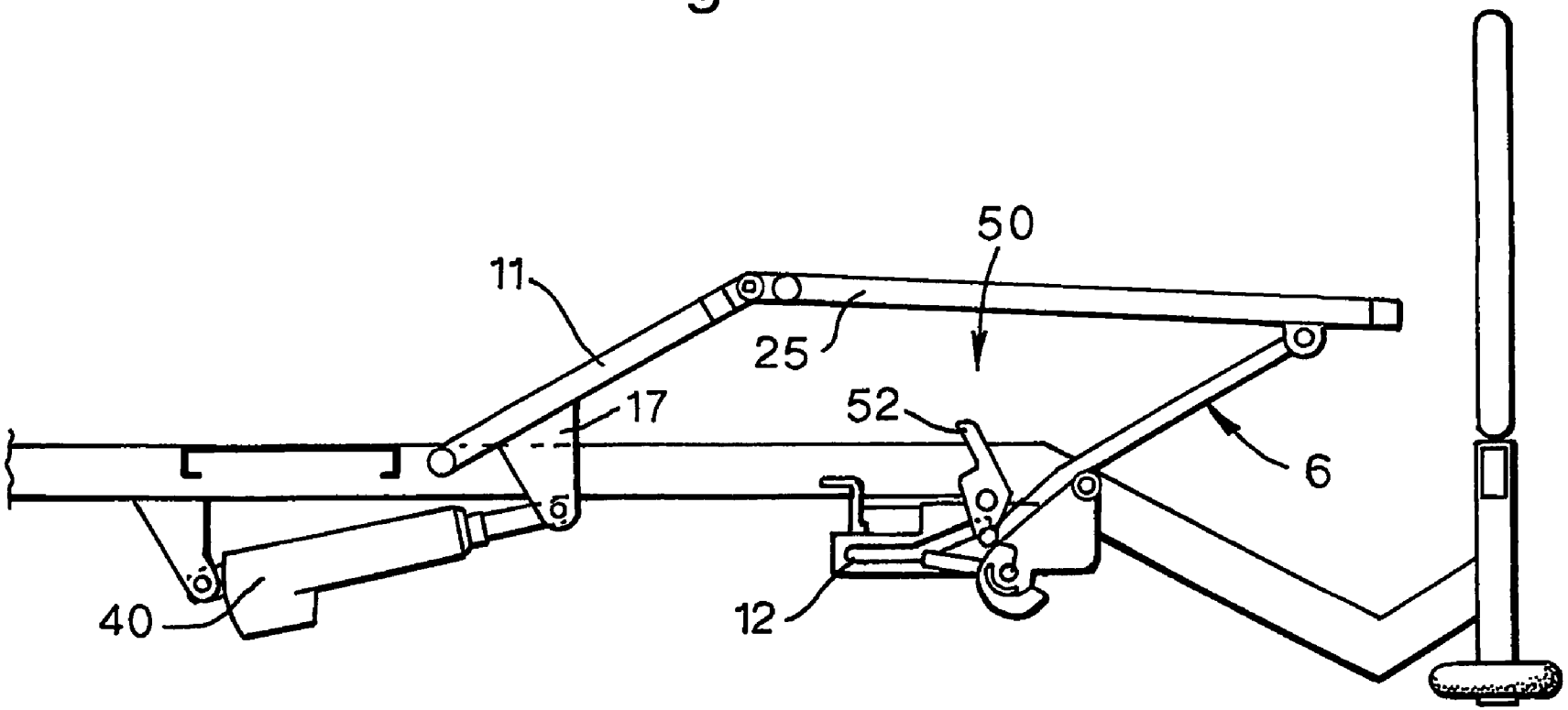
FIG. 7 is a schematic view of the support surface with the thigh section and calf section in the raised horizontal configuration according to a further embodiment of the invention.
Figure 8:
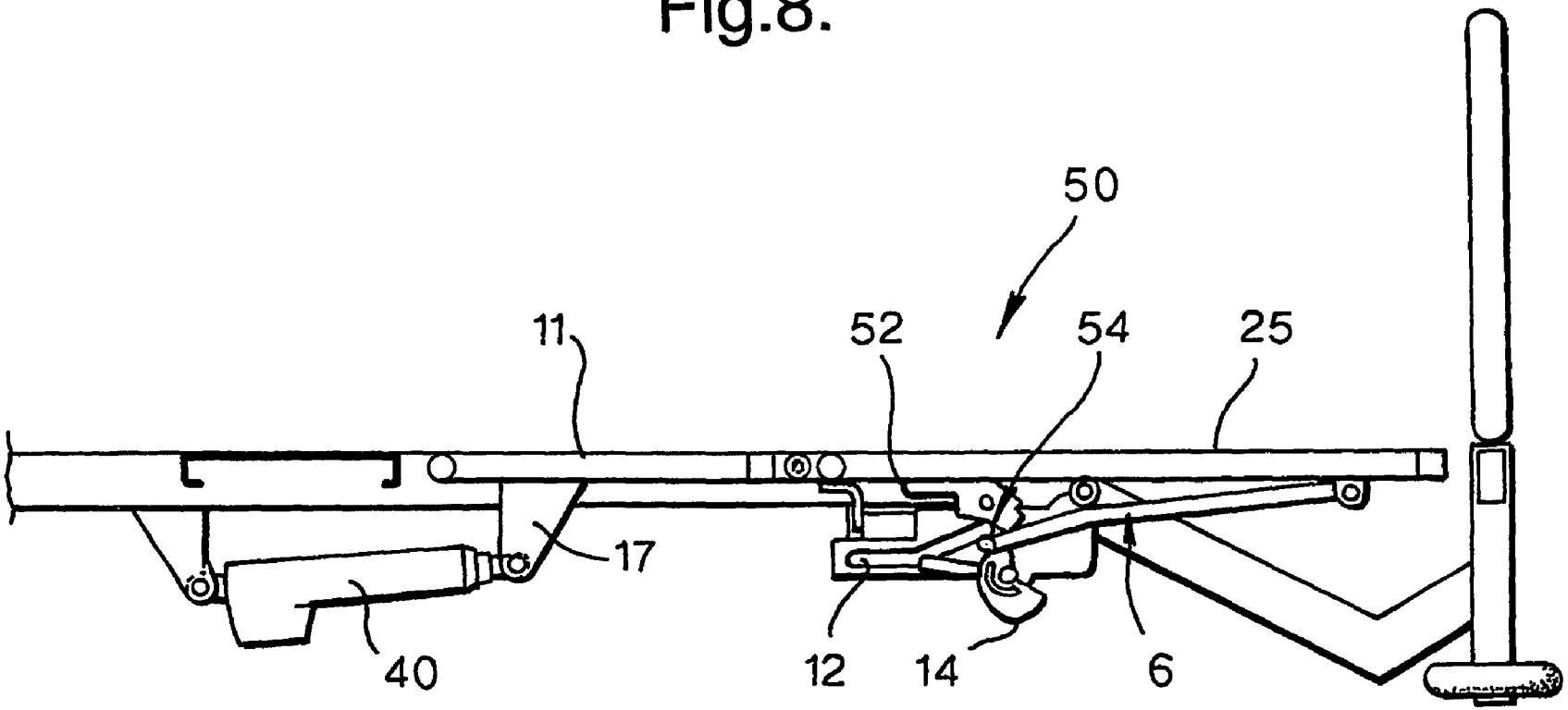
FIG. 8 is a schematic view of the support surface of FIG. 7 in the bed configuration.

Referring now to FIGS. 7 and 8, there is shown an enhancement to the embodiments shown in FIGS. 3 to 6. The enhancement provides a rotatable latch 50 located on the panel supporting the slotted slide 12 adjacent the detent 26. The latch is either provided with a biasing spring (not shown) or designed in such a manner that the force of gravity naturally biases the latch 50 to the position shown in FIG. 7. In this position, the latch provides a surface which blocks the exit from the detent 26 such that if the stay of the link 6 is in the detent 26 it cannot move out of the detent until the latch 50 is rotated to a non-locking position. Rotation of the cam 14 is not possible in this situation. The effect of the latch therefore is to prevent undesired movement of the stay of the link 6 out of the detent 26 when the calf section 25 is in the raised horizontal configuration shown in FIG. 7. It is envisaged that the latch 50 could be rotated manually under some controlled circumstances when the bed is in the position shown in FIG. 7.

Referring to FIG. 8, the latch 50 also includes a portion 54 of reduced dimension such that when this portion 54 faces the detent 26 it is spaced therefrom to allow movement to the stay of link 6 out of the detent 26. Thus, when the latch 50 is in the position shown in FIG. 8 the stay of link 6 can move out of detent 26 upon movement of the cam 14. In this position, therefore the latch 50 is in a non-locking position and allows the calf section 25 to move to the chair configuration as described above.

The latch 50 is provided with an upwardly extending finger 52 arranged to contact the lower surface of the calf section 25 of the bed. As can be seen in FIG. 8, when the calf section 25 is in its lowered bed configuration it urges on the finger 52, against the spring force or gravity, to keep the latch 50 in its non-locking position. Thus, as long as the cam 14 is rotated to move the stay of link 6 out of the detent 26, as described above, the calf section 25 can move to the chair configuration upon the lifting of the thigh section 11. On the other hand, when the calf section 25 is raised, the biasing force (whether by spring or gravity) on the latch 50 causes it to move to the locking position shown in FIG. 7. Of course, if the stay of link 6 has already moved out of the detent 26, the locking action will not have any effect on it and thus on the position of the calf section 25. It will be noted also, that upon the lowering of the calf section back to the bed position, the stay of link 6 will eventually slide in slot 12 to the surface 54 of the latch 50 and push this out of the way, against the biasing force, to move into the detent 26 ready for the next bed movement.

Although the embodiments of FIGS. 1 to 6 show slide mechanism in which the guide surface is provided by a rod, other embodiments are envisaged. For example, the mechanism 2 and 20 could be replaced by supports with slotted guides, similar to the slotted guide 12 of the calf section 25. The advantage in terms of efficacy and simplicity are derived by a guide surface which, in the case of the back section 15, provides a guide surface angled or bending upwardly towards the head of the bed.

It will be apparent to the skilled person that the embodiments described herein provide an effective lengthening of the support surface of the bed, particularly at the position of the base of a patient's spine. Advantageously, this lengthening is approximately matched to the effective lengthening of a person's back as that person is raised from a lying position to a sitting position.

It is to be understood that the embodiments of thigh and calf sections disclosed herein could be provided independently of the embodiment of back section.

The profiling surfaces disclosed herein are suitable for any apparatus requiring the positioning of a person from supine to chair position for example, beds tables, couches, stretchers or the like.

The invention claimed is:

1. A profiling bed comprising a bed frame supporting a mattress support surface having at least a back section, a seat section, and a leg section, the back and leg sections being pivotally connected to the bed frame for movement from a substantially horizontal configuration to a profiled configuration, the pivotal connection of the back section being mounted on a slide mechanism to move away from the seat section and also to move upwardly relative to the bed frame as it is pivoted towards the profiled configuration, with the slide mechanism defining a path of travel for the pivotal connection wherein the path of travel is oriented at an angle to the horizontal both when the back section is in the substantially horizontal configuration and also in the profiled configurations, wherein the leg section includes a thigh section and a calf section, the thigh section being pivotally mounted on the bed frame at one end and pivotally connected to the calf section at the other end, further including a link connected between the calf section and the frame, wherein the link is both pivotally and translationally affixed to both the calf section and the frame has been inserted.

2. A profiling bed as claimed in claim 1 wherein the movement of the back section brings about a simultaneous movement of the leg section to bring the bed into a profiled configuration to a chair position.

3. A profiling bed as claimed in claim 1 wherein the thigh section is mounted on a slide mechanism to move away from the seat section as it is pivoted towards the profiled configuration.

4. A profiling bed as claimed in claim 1 including means operable selectively to move the calf section either in a bed or substantially raised horizontal configuration or in a chair configuration during movement of the thigh section.

5. A profiling bed as claimed in claim 4 wherein the calf section moving means includes a calf section support which can either engage a detent or follow a guide to provide for said configurations of the calf section.

6. A profiling bed as claimed in claim 4 including a stop operable to prevent movement of the calf section to one or other of said configurations.

7. A profiling bed as claimed in claim 1 wherein the back section slide mechanism includes a support member angled upwardly in the direction of the back section and a follower member coupled to the back section and slidable on the support member during pivoting of the back section.

8. A profiling bed as claimed in claim 1 including an actuator coupled to the back section to effect pivoting of the back section.

9. A profiling bed as claimed in claim 8 wherein the actuator is pivotably coupled to the back section at a location spaced from a coupling position of the slide mechanism to the back section.

10. A profiling bed as claimed in claim 1 wherein the slide mechanism defines a linear path of travel for the pivotal connection.

11. A profiling bed comprising:

a. a bed frame having a head end and a foot end;

b. a back section;

c. a thigh section including a frame end and a calf section end, the frame end being pivotally mounted with respect to the bed frame whereby the thigh section may pivot from a substantially horizontal orientation to an inclined orientation; and d. a calf section pivotally mounted to the calf section end of the thigh section, further including a link connected between the calf section and the frame, wherein the link is both pivotally and translationally affixed to both the calf section and the frame has been inserted after the term, wherein:

(1) the back section is pivotally mounted with respect to the bed frame for movement from a substantially horizontal orientation to an inclined orientation, and (2) the entirety of the back section translates upwardly relative to the bed frame when the back section is pivoted towards the inclined orientation.

12. The profiling bed of claim 11 wherein pivoting of the back section to an inclined orientation simultaneously pivots the thigh section into an inclined orientation.

13. The profiling bed of claim 11 wherein:

a. the frame end of the thigh section is also translatably mounted with respect to the bed frame, and b. the thigh section translates away from the head end of the bed frame when pivoted into the inclined orientation.

14. The profiling bed of claim 11 wherein the calf section is selectably movable into the following fixed positions:

(1) a bed position oriented at least substantially horizontally and at least substantially parallel to the thigh section;

(2) a raised horizontal position oriented at least substantially horizontally and at an angle to the thigh section; and (3) a chair position oriented at an angle to a horizontal plane, and at an angle to the thigh section.

15. The profiling bed of claim 11 wherein:

a. the link is translationally affixed within a slot defined in the frame, and b. a detent is defined within the slot, whereby the link may be engaged against translation within the slot.

16. The profiling bed of claim 11 further including a link connected between the calf section and the frame, wherein the link is:

a. pivotally affixed to both the frame and the calf section, and b. translationally affixed within a slot defined in the frame, the slot having a detent defined therein, whereby the link may be engaged against translation along the slot within the detent.

17. A profiling bed comprising:

a. a bed frame extending along a bed frame plane between a head end and a foot end;

b. a back section pivotally mounted with respect to the bed frame at a joint, the joint being translatably mounted with respect to the bed frame to travel along a path oriented at a non-zero angle with respect to the bed frame plane;

c. a strut having:

(1) a first end pivotably coupled to the back section at a strut pivot, and (2) an opposing second end pivotably coupled with respect to the frame;

d. an expanding link having adjustable length, the expanding link being at least partially formed by an actuator, having:

(1) a first end pivotably coupled to the back section at an actuator pivot, and (2) an opposing second end pivotably coupled with respect to the frame, wherein:

(1) the joint is situated between the strut pivot and the actuator pivot, (2) the back section is pivotally mounted with respect to the bed frame for movement from a substantially horizontal orientation to an inclined orientation, and (3) the entirety of the back section translates upwardly relative to the bed frame when the back section is pivoted towards the inclined orientation.

18. The profiling bed of claim 17 wherein the joint is translatably mounted with respect to the bed frame to travel along a linear path.

19. A profiling bed including:

a. a bed frame, b. a back section:

(1) including a joint about which the back section pivots with respect to the bed frame, the joint being translatably mounted with respect to the bed frame to travel along a path oriented at a nonzero angle with respect to a horizontal plane, (2) being movable with respect to the bed frame between an at least substantially horizontal orientation and an inclined orientation, wherein the entirety of the back section travels upwardly relative to the bed frame when the back section moves between the horizontal orientation and the inclined orientation, c. a strut having:

(1) a first end pivotably coupled with respect to the back section at a strut pivot, and (2) an opposing second end pivotably coupled with respect to the frame;

d. an expanding link having adjustable length, the expanding link being at least partially formed by an actuator, the expanding link having:

(1) a first end pivotably coupled with respect to the back section at an actuator pivot, and (2) an opposing second end pivotably coupled with respect to the frame, wherein the joint is situated between the strut pivot and the actuator pivot.

20. The profiling bed of claim 19 wherein the joint is translatably mounted with respect to the bed frame to travel along a linear path.

21. A profiling bed including:

a. a bed frame, b. a back section:

(1) including a joint about which the back section pivots with respect to the bed frame, the joint being translatably mounted with respect to the bed frame to travel along a path oriented at a nonzero angle with respect to a horizontal plane, (2) being movable with respect to the bed frame between an at least substantially horizontal orientation and an inclined orientation, wherein the entirety of the back section travels upwardly relative to the bed frame when the back section moves between the horizontal orientation and the inclined orientation, c. a thigh section including a frame end and a calf section end, the frame end being pivotally mounted with respect to the bed frame whereby the thigh section may pivot from a substantially horizontal orientation to an inclined orientation, d. a calf section pivotally mounted with respect to the calf section end of the thigh section, e. a link connected between the calf section and the frame, wherein the link is both pivotally and translationally affixed with respect to both the calf section and the frame.

22. The profiling bed of claim 21 wherein the joint is translatably mounted with respect to the bed frame to travel along a linear path.

23. A profiling bed including:

a. a bed frame, b. a back section:

(1) including a joint about which the back section pivots with respect to the bed frame, the joint being translatably mounted with respect to the bed frame to travel along a path oriented at a nonzero angle with respect to a horizontal plane, (2) being movable with respect to the bed frame between an at least substantially horizontal orientation and an inclined orientation, wherein the entirety of the back section travels upwardly relative to the bed frame when the back section moves between the horizontal orientation and the inclined orientation, c. a thigh section including a frame end and a calf section end, the frame end being pivotally mounted with respect to the bed frame whereby the thigh section may pivot from a substantially horizontal orientation to an inclined orientation, d. a calf section pivotally mounted with respect to the calf section end of the thigh section, e. a link connected between the calf section and the frame, wherein the link is:

(1) pivotally affixed with respect to both the frame and the calf section, and (2) translationally affixed with respect to the frame, wherein the path of translation has a detent defined therein, whereby the link may be engaged against translation within the detent.

24. The profiling bed of claim 23 further including an actuatable member adjacent the detent, wherein the member may be actuated to secure the link within, or to exclude the link from, the detent.

* * * * *